US005564851A

United States Patent [19]

Connelly et al.

[11] Patent Number: 5,564,851

[45] Date of Patent: Oct. 15, 1996

[54] ROLLER APPLICATOR FOR DISTRIBUTING PREPARATIONS TO THE SKIN

[75] Inventors: Patrick P. Connelly, 3101 Woodside Dr., Fairfield, Ohio 45014; Samuel L. Belcher, Cincinnati, Ohio

[73] Assignee: Patrick P. Connelly, Fairfield, Ohio

[21] Appl. No.: 222,828

[22] Filed: May 17, 1994

[51] Int. Cl.[6] ..... B05C 17/025

[52] U.S. Cl. ..... 401/197; 401/6; 401/208

[58] Field of Search ..... 401/197, 6, 208; 132/320

[56] References Cited

U.S. PATENT DOCUMENTS

| | | | |
|---|---|---|---|
| D. 113,690 | 3/1939 | Tresenberg . | |
| D. 307,949 | 5/1990 | Wong . | |
| D. 308,734 | 6/1990 | Markovich et al. . | |
| D. 315,033 | 2/1991 | Carugati . | |
| D. 333,191 | 2/1993 | Rainen . | |
| D. 337,856 | 7/1993 | Butler et al. . | |
| 2,498,980 | 2/1950 | Bowling et al. . | |
| 2,591,530 | 4/1952 | Findley et al. | 401/197 |
| 2,605,487 | 8/1952 | Bugg | 401/197 |
| 2,605,488 | 8/1952 | Bugg | 401/197 |
| 2,684,497 | 7/1954 | Graham | 401/197 |
| 2,698,451 | 1/1955 | Wonso | 401/197 |
| 2,849,157 | 8/1958 | Remien, Jr. | 401/197 R |
| 2,887,711 | 5/1959 | Hutchinson . | |
| 3,099,034 | 7/1963 | Leland . | |
| 3,588,264 | 6/1971 | Mallindine . | |
| 3,712,748 | 1/1973 | Wilmans . | |
| 4,943,176 | 7/1990 | Baker . | |

FOREIGN PATENT DOCUMENTS

| | | | |
|---|---|---|---|
| 1164203 | 10/1958 | France | 401/197 |
| 2330463 | 6/1975 | France | 401/197 |
| 2511583 | 9/1976 | Germany | 401/197 |
| 3447845 | 7/1986 | Germany | 132/320 |
| 595888 | 2/1978 | Switzerland | 401/197 |
| 672738 | 5/1952 | United Kingdom | 401/197 |
| 2008983 | 6/1979 | United Kingdom | 401/197 |

*Primary Examiner*—Steven A. Bratlie
*Attorney, Agent, or Firm*—Dinsmore & Shohl

[57] ABSTRACT

A roller applicator device and method for distributing preparations on a user's skin and, in particular, hard to reach body parts. The applicator comprises a roller portion for containing and distributing a preparation, a detachable and extendable handle portion, and a resealable storage container. In order to use the applicator, the extendable handle portion is attached to the roller portion. The roller portion comprises a sealed canister containing a preparation and having a porous layer on the exterior of the canister for distributing the preparation to the user's skin. The canister has apertures through which the preparation is discharged due to centrifugal forces incurred by rolling the applicator over the user's body. There is a locking device that when engaged, prohibits the roller from rotating and may be used to rub preparation into the user's skin. After using the applicator, the handle may be detached so that the roller portion may be returned to the resealable container to prevent sand and other debris from contaminating the preparation. In addition, the resealable container, prevents the preparation from effusing out of the canister.

13 Claims, 7 Drawing Sheets

ROLLER APPLICATOR FOR DISTRIBUTING PREPARATIONS TO THE SKIN

BACKGROUND OF THE INVENTION

1. Field of the Invention

This invention relates generally to a roller applicator, and a method for using the roller applicator, and more particularly, to a disposable roller applicator containing preparations such as suntan lotion, suntan oil, skin creams or other types of preparations to be applied to the skin and having an extendable handle so that the user may access hard to reach places without assistance from another person.

2. Related Art

In regard to suntan lotions or suntan oils, the following is a familiar scene: a crowded beach in hot weather, a lone sunbather struggling to cover his or her body with suntan lotion or sunscreen, or maybe even aloe after exposure to too much sun. The unfortunate sunbather is contorting his or her body in near impossible postures attempting to spread the preparation to the middle of his or her back. Applying preparations on the beach can be a messy affair, with sand contaminating the lotion and adhering to the lotion remaining on one's hands after application.

Skin applicators, including roller applicators, have been designed to assist people in applying preparations to the skin in a neater and more convenient manner. However, well known roller applicators are complicated and expensive to make. Currently, roller applicators employ complicated gears, seals and valves to discharge their contents. Thus, the need for a simple, neat, disposable, inexpensive and convenient to use roller applicator exists.

Accordingly, it is an object of this invention to provide an improved roller applicator which is inexpensive to manufacture; is easy and convenient to use; does not employ seals, gears or valves; has exchangeable, disposable canisters containing various preparations; is neat; can be extended to distribute preparations to the skin of hard to reach areas of the body; can be used to either distribute or rub preparations into the user's skin; delivers preparations that are free of sand or other contaminants; and evenly distributes the preparation with no mess to the hands.

It is another object of this invention to provide a method of using the improved roller applicator which is easy and convenient and keeps sand or contaminants out of the preparations.

SUMMARY OF THE INVENTION

A preferred roller applicator of the present invention comprises a roller portion, a detachable and extendable handle portion, and a resealable container for storing the roller portion. The roller portion has a canister which is covered by a layer of porous material for distributing the preparation onto a user's skin. The canister has a plurality of apertures for discharging the preparation to the layer of porous material to the skin. Due to the viscosity of the liquid, the size of the apertures, and the wicking action of the porous layer, the preparation passes into and through the porous material as the roller is rolled. The porosity of the porous layer and the quantity, size, and arrangement of the apertures are carefully balanced according to the viscosity of the preparation so that sufficient, but not excessive, preparation is distributed to the user's skin.

In order to use the roller applicator, the roller portion is removed from the resealable container and the handle portion is attached to the canister by inserting a neck portion of the handle into a receptacle in the canister. The handle has a simple locking mechanism for preventing unwanted rotation of the roller portion. When the locking mechanism is engaged, the roller applicator can be used to rub the preparation into the user's skin. After use, the handle is removed from the roller portion, and the roller portion is stored in the container. The container is designed to fit tightly over the roller portion so that the porous layer is compressed to prevent the preparation from emptying out of the canister when the roller is not in use.

Containers storing roller portions having a variety of preparations suitable for application to skin may be used interchangeably with a single handle. A user simply attaches the roller portion containing the desired preparation to the handle. Likewise, if the user desires a different preparation, he or she simply changes the roller portion of the applicator. The containers with the roller portion are disposable when the preparation is depleted. However, the handle may be retained for use with other roller portions.

A method of using the improved roller applicator comprises attaching an extendable handle to a roller portion, removing the roller portion from a sealed container, distributing preparation on a user's skin, returning the roller portion to the resealable container, detaching the handle from the roller portion, and sealing the resealable container to prevent contamination and leakage of the preparation. In addition, the method of using the roller applicator may include the steps of: engaging the locking mechanism and rubbing the preparation into the user's skin.

DETAILED DESCRIPTION OF THE PREFERRED EMBODIMENT

Figures 1, 4:
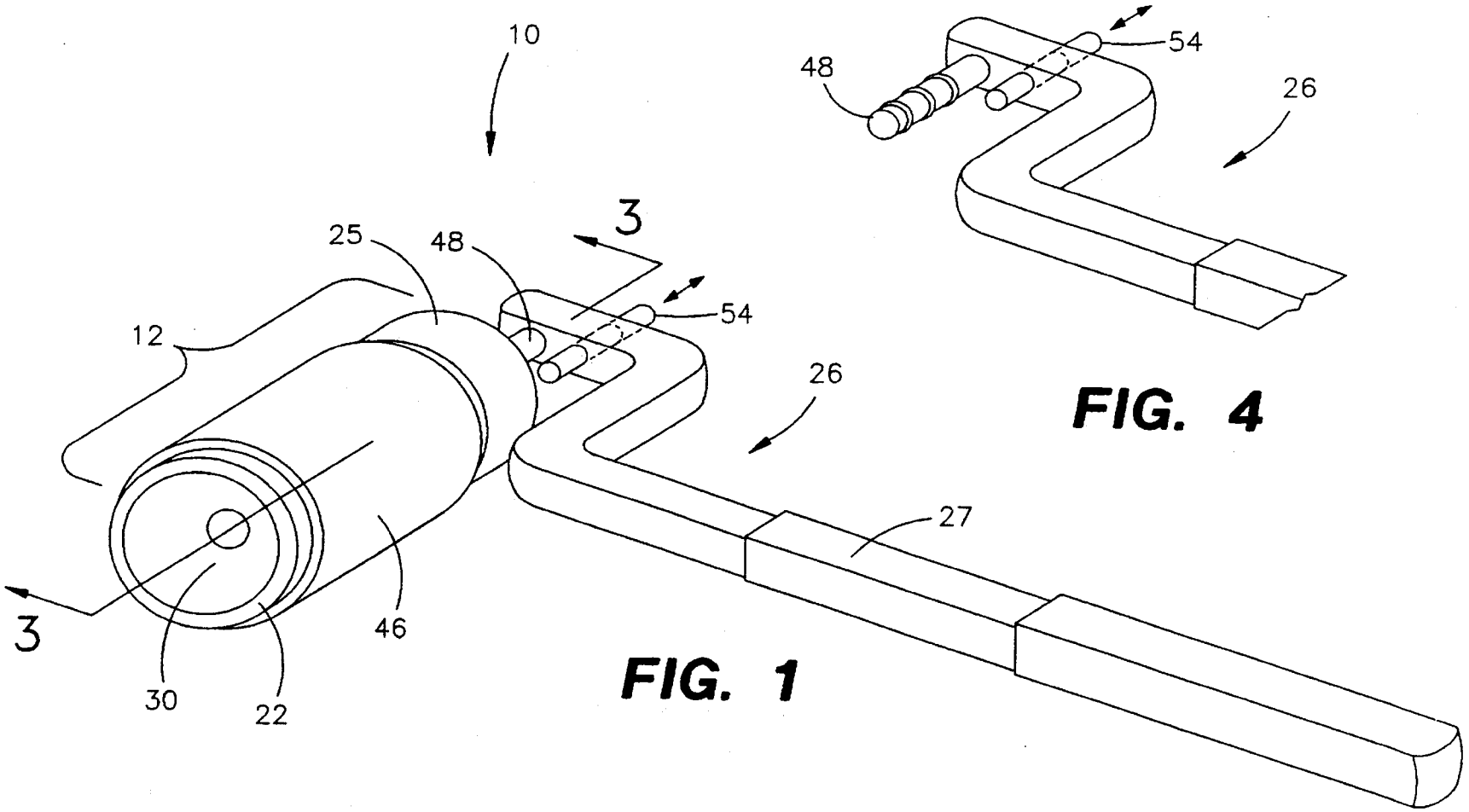
FIG. 1 is a perspective view of the assembled and ready to use roller applicator.
FIG. 4 is a perspective view of the handle portion illustrating the neck portion.
Figure 2:
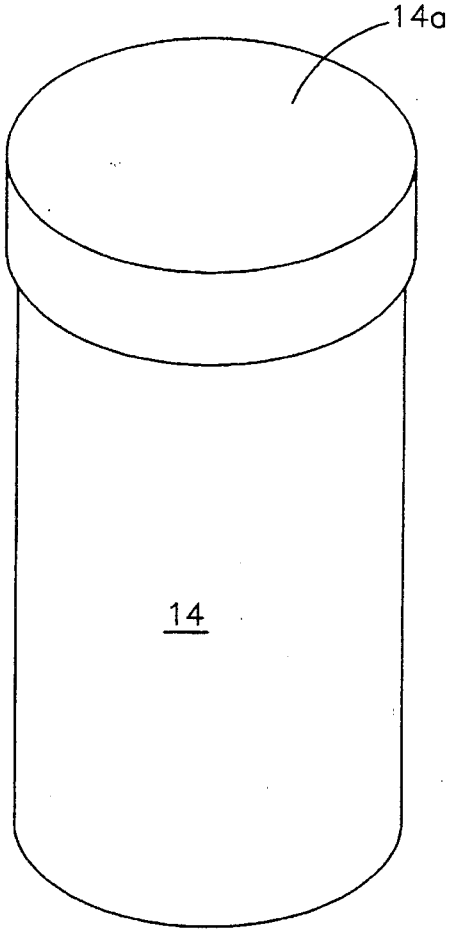
FIG. 2 is a perspective view of the container portion.

This discussion is primarily directed to using the present invention as a unique roller applicator for a sunscreen such as a suntan lotion or oil. While this is contemplated as an important use of the device, it should be understood that it may be used for applying and rubbing in any fluid preparation to the skin including, but not limited to: oils, lotions, creams, gels, bath or shower gels, after sun lotions, and ointments. The detailed description of the roller applicator device and its use with suntan lotion or suntan oil will allow one skilled in the art to readily adapt this invention to other fluid preparations suitable for application to the skin. In the drawings, like characters represent like parts in each of the views. Referring now to FIGs. 1 and 2, the invention (10) refers generally to a roller applicator device. The roller applicator (10) comprises a roller portion (12), a handle portion (26), and a resealable container (14) portion.

Figure 3:
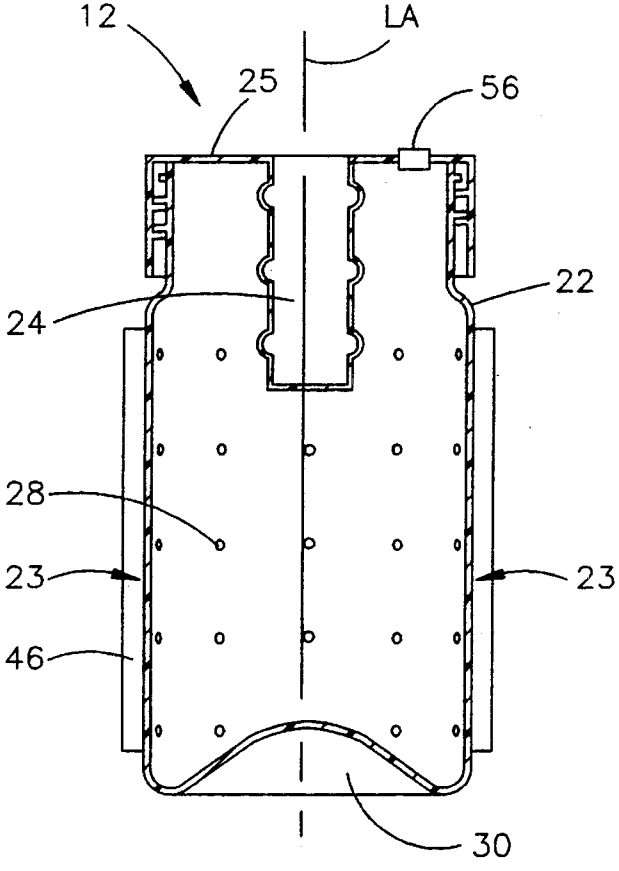
FIG. 3 is a section view of the roller portion along line 3—3 of FIG. 1 illustrating the apertures of the canister.

As shown in FIG. 1, roller portion (12) comprises a canister (22) for containing a preparation (not shown) for applying to a user's skin. Canister (22) has a receptacle (24) as shown in FIG 3. located at a first end (25) for attaching a handle (26). Canister (22) has a plurality of apertures (28) located throughout its circumference for discharging the preparation from canister (22) to its exterior surface (23). The quantity, size, and arrangement of apertures (28) are determined according to the viscosity of the preparation and this relationship is discussed below. Canister (22) has a concave bottom (30) located at its second end for urging the preparation against apertures (28). Concave bottom (30) permits the device (10) to evenly discharge the preparation, especially preparations having a low viscosity, through all apertures (28) rather than collecting at the bottom.

Figure 5:
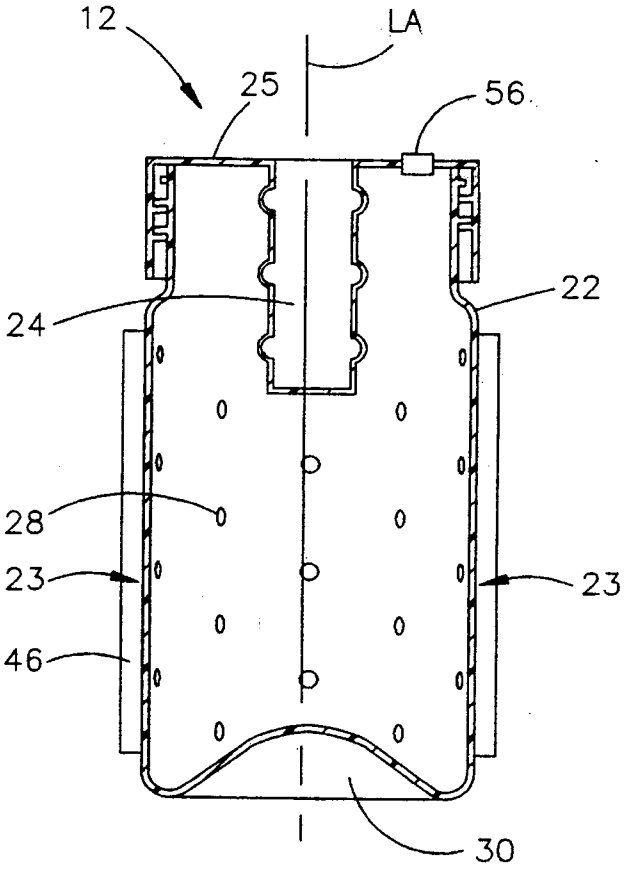
FIG. 5 is a section view of the roller applicator illustrating an alternative embodiment of the apertures of the canister for use with a high viscosity skin preparation.

A porous layer (46) is located around canister (22) for passage of the preparation from apertures (28) onto the user's skin. The thickness and type (i.e. porosity) of porous layer (46) employed is dependent upon the viscosity of the preparation and the quantity, size, and arrangement of apertures (28). A preferred embodiment of roller applicator (10) containing a high viscosity preparation such as suntan lotion is shown in FIG. 5. The canister (22) has large diameter apertures in the range from about 0.015 inch (0.0381 cm) to about 0.125 inch (0.318 cm) when the preparation is a lotion having a viscosity of about 100 times that of water and a specific gravity of 1.0. Porous layer (46) is an open cell foam type. A suitable foam has been found to have a porosity 4.5 PCF and a thickness ranging from about 0.030 inch (0.076 cm) to about 0.125 inch (0.318 cm). There are 44 apertures in canister (22) distributed in 11 columns of 4 apertures each to evenly distribute the preparation to the skin. Those skilled in the art may readily select a specific preparation for the skin, quantity, size and arrangement of apertures, and porosity and thickness of porous layer (46) which permits even distribution of the preparation onto a user's skin. However, a preferred embodiment of roller applicator (10) for a low viscosity preparation such as an oil having a viscosity of about 8 times that of water and a specific gravity of about 0.86 is shown in FIG. 3. The device has smaller diameter apertures ranging from about 0.015 inch (0.0381 cm) to about 0.100 inch (0.254 cm). Preferably, porous layer (46) is an open cell type of foam having a porosity of about 4.5 PCF and a thickness ranging from 0.015 inch (0.0381 cm) to about 0.100 inch (0.254 cm). This embodiment has about 55 apertures arranged such that more apertures are located near the first end so that the oil is distributed evenly. Those skilled in the art may readily select a different arrangement of apertures as well as various sizes of apertures instead of same size apertures arranged as shown in FIGS. 3 and 5. There are unlimited embodiments that will balance the preparation viscosity with aperture quantity, size and arrangement, and porosity and thickness of the porous layer that yield suitable results. It should be understood that the embodiments (FIG. 3 and FIG. 5) discussed here are the preferred embodiments for distributing an oil and a lotion respectively; however, there are an unlimited number of suitable combinations of aperture size, porous layer type and thickness and preparation type that would be suitable.

Preferably, canister (22)is permanently sealed after being filled with fluid preparation and is disposed of after depletion of the preparation. In addition, canister (22) has specifically sized apertures (28) opening to an exterior surface and porous layer (46) for each particular preparation, and if canister (22) was refilled with a preparation having a different viscosity, roller applicator (10) may not work properly.

Handle (26) attaches to canister receptacle (24) by a neck portion (48). Neck (48) projects from an end of handle (26) for inserting in receptacle (24), and about which roller portion (12) rotates. The canister receptacle (24) is substantially parallel to the longitudinal axis (LA) of the canister (22) as shown in FIGS. 3 and 5. Neck (48) is grooved as shown in FIG. 4 for fitting securely into receptacle (24) which is notched to receive grooved neck (48). Although this discussion describes a grooved neck (48) and a notched receptacle (24), it should be understood that one skilled in the art may readily select any type of fitting which allows neck (48) and receptacle (24) to rotatably engage without coming apart unless specifically detached by a user. Handle (26) has an extendable grip portion (27) for accessing hard to reach parts of the body. As shown in FIG. 1, handle (26) is extendable telescopically; however, one skilled in the art may readily select a suitable means for extending grip portion (27) of handle (26).

Roller applicator (20) has a locking device (54, 56) to prevent rotation of roller portion (12) so that applicator (20) may be used to rub the preparation into the user's skin after it has been distributed on the user's skin. Preferably, the locking device comprises a pin (54) located on handle (26) for inserting into a hole (56) located on the first end of canister (22) adjacent receptacle (24). Locking device (54, 56) is engaged by aligning pin (54) with hole (56) and pushing on pin (54) such that it slides into hole (56). Resealable container (14) is sized such that canister (22) fits tightly within container (14) to prevent preparation from leaking out of canister (22). When lid (**14*a*) of resealable container (14) is attached, roller applicator (10**) may be carried in a purse, bag, pocket, etc. without leaking fluid preparation.

A preferred method for applying preparation to a user's body with roller applicator (10) includes the following steps: attaching extendable handle portion (26) to roller portion (12) by inserting neck (48) into inner canister receptacle (24), removing roller portion (12) from resealable container (14), rolling roller portion (12) on the user's body to distribute preparation onto the user's skin, returning roller portion (12) to resealable container (14) to prevent contamination by dirt and sand, detaching handle (26) for storing roller portion (12), and sealing said resealable container (14). After distributing preparation onto the user's skin, additional steps involving engaging locking device (54, 56) and rubbing the preparation into the skin may be performed. Several other embodiments of the method of using this device are suitable, such as varying the order of the steps. For example, the step of removing roller portion (12) from resealable container (14) could be done before attaching extendable handle (26) to roller portion (12), etc. However, these other embodiments are not the preferred method embodiment.

In order to contribute to a better understanding of this invention and not by way of limitation, the following examples are provided.

EXAMPLE

The proper size of apertures in the canister, that achieved a reasonable flow rate of lotion to the porous layer, was determined by experiments. The canister used for testing was made of plastic and had a diameter of about 1.75 inches (4.45 cm), a height of 3.5 inches (8.89 cm), and held slightly over 110 ml of fluid. Experiments were done using two hole diameters, 1/16 inches (0.159 cm) and 3/32(0.238 cm) inches. Wall thicknesses for the container varied between 40 to 50 mils. Flow rates were measured for a range of liquid heights. The height of the liquid causing the flow can also be related to a pressure, If expressed in terms of inches of liquid, this is called the pressure head of the liquid.

A. Low Viscosity Skin Preparation

A mineral oil product (No-Ad Tanning Oil) having a viscosity approximately 8 times that of water and a specific gravity of about 0.86 was tested for flow through a 3/32 inch (0.238 cm) diameter hole. Flow rates were measured for a range of fluid heights in the container. Table I contains the volumetric flow rates for mineral oil based products at 72° F.

| PRES- | | VOLUMETRIC FLOW RATES (ml/sec/hole) | | | | |
|---|---|---|---|---|---|---|
| | | 1/16" DIAMETER HOLE | | | | 3/32" |
| SURE (in. $H_2O$) | HEAD (in. oil) | 1 hole | 3 holes | 5 holes (trial 1) | 5 holes (trial 2) | DIAM. 1 hole |
| 2.25 | 2.60 | 0.400 | 0.417 | 0.400 | 0.400 | 0.714 |
| 2.02 | 2.34 | 0.278 | 0.256 | 0.286 | 0.250 | 0.588 |
| 1.79 | 2.07 | 0.238 | 0.222 | 0.222 | 0.222 | 0.556 |
| 1.56 | 1.81 | 0.189 | 0.196 | 0.200 | 0.167 | 0.435 |
| 1.33 | 1.54 | 0.182 | 0.167 | 0.154 | 0.167 | 0.400 |
| 1.11 | 1.28 | 0.152 | 0.145 | 0.143 | 0.143 | 0.333 |
| 0.86 | 1.00 | 0.110 | 0.108 | 0.105 | 0.091 | 0.256 |
| 0.63 | 0.73 | 0.089 | 0.081 | 0.074 | 0.071 | 0.172 |

Figure 6:
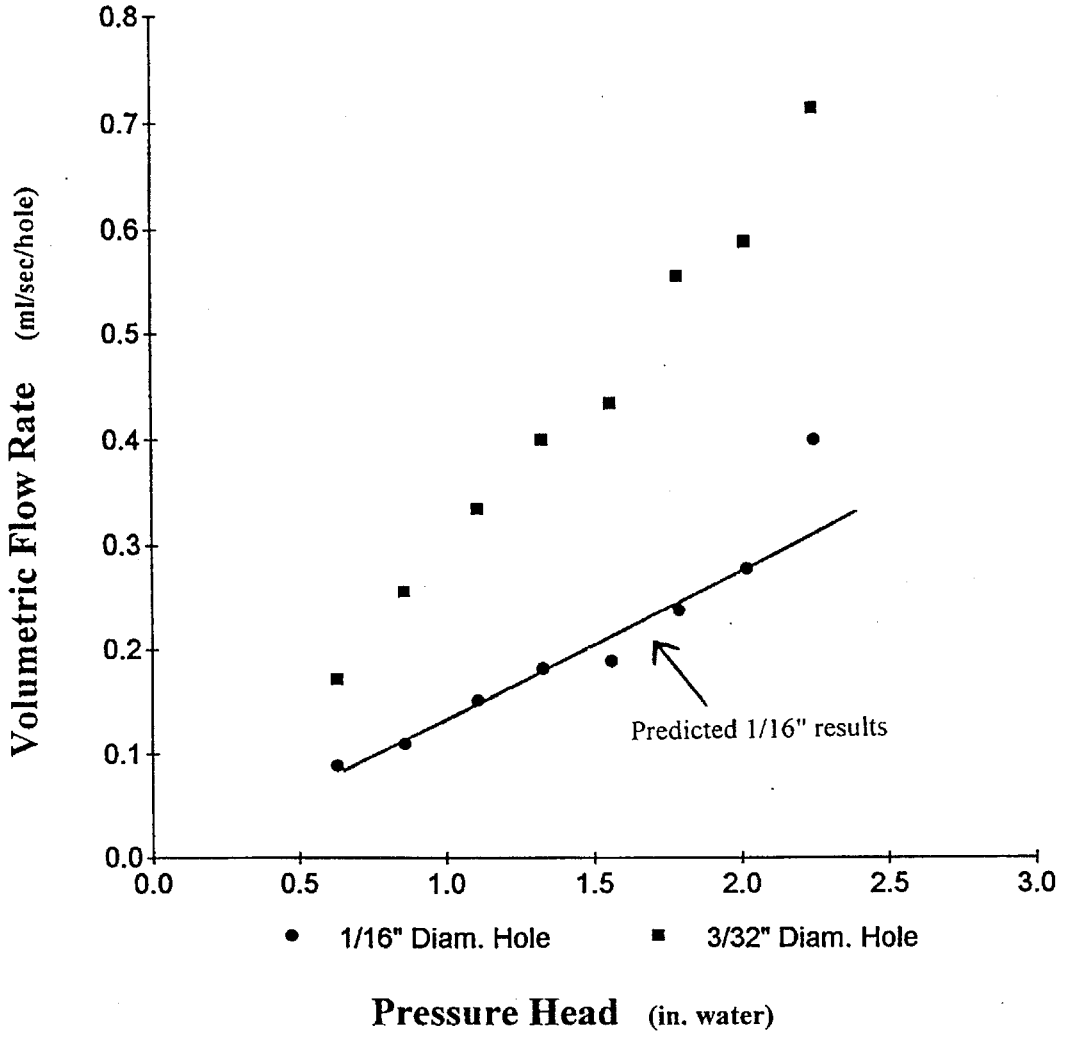
FIG. 6 is a graph depicting flow data for a low viscosity skin preparation including two sets of data points and one predicted curve for flow data of a low viscosity skin preparation through a canister.

As shown on the graph in FIG. 6, the data fell on a straight line and an extrapolation of the results to zero pressure head gave a zero flow rate. The bottom set of data points represent flow rates versus pressure head for a 1/16 inch (0.159 cm) diameter hole. Because the flow rate should be proportional to the square of the diameter of the holes, the data for the 3/32 inch (0.238 cm) diameter hole was used to predict results for the 1/16 inch (0.159 cm) diameter hole. Since the results predicted very well the 1/16 experimental data, the theoretical model was used to predict flow rates for a range of hole sizes as is shown in FIG. 7.

Figure 7:
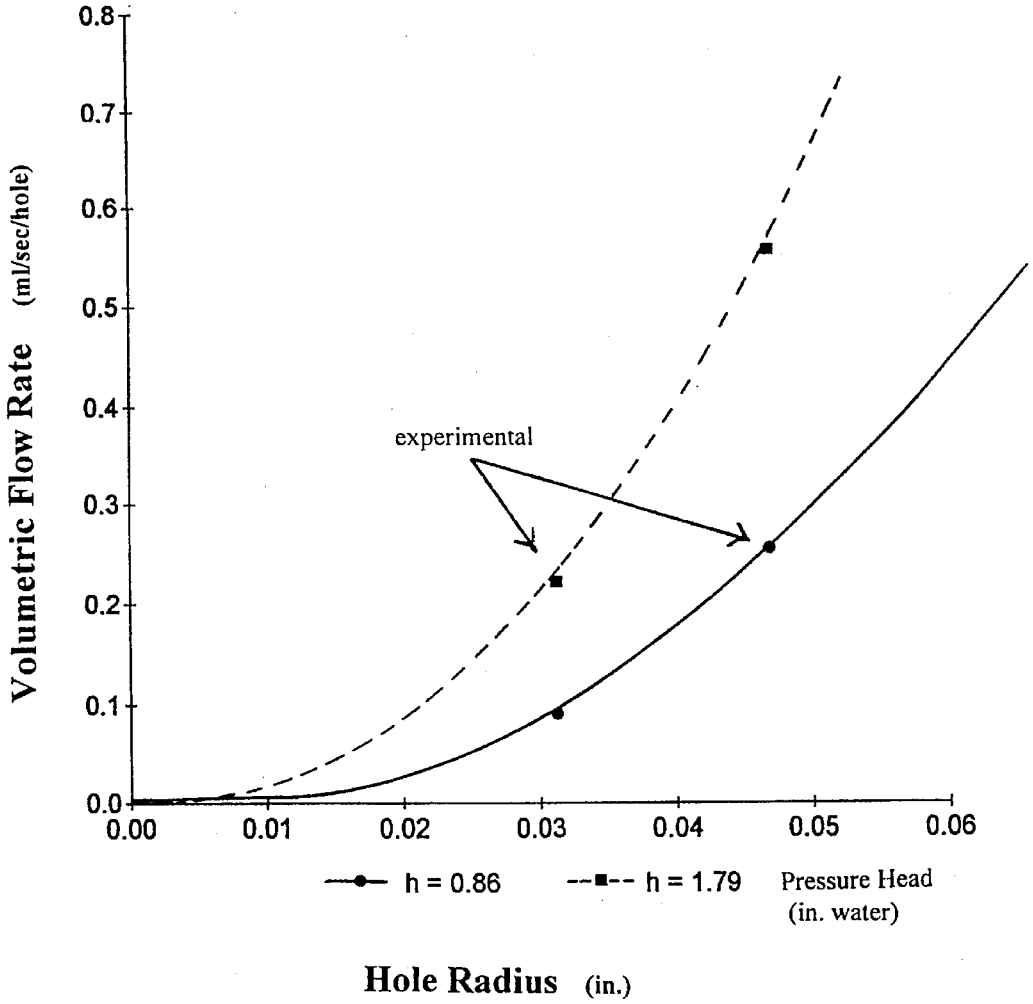
FIG. 7 is a graph showing flow rate versus aperture radius for a low viscosity skin preparation through a canister.

FIG. 7 shows a graph with two curves, each curve is for a given pressure head. The curves correspond to flow rates for mineral oil heights of 1.0 inches (2.54 cm) and 2.0 inches (5.08 cm). The graph also shows the four experimental data points used to determine the relationship. These relationships can be used to predict flow rates for any given hole size or to determine the hole size necessary to achieve a given flow rate.

Figure 8:
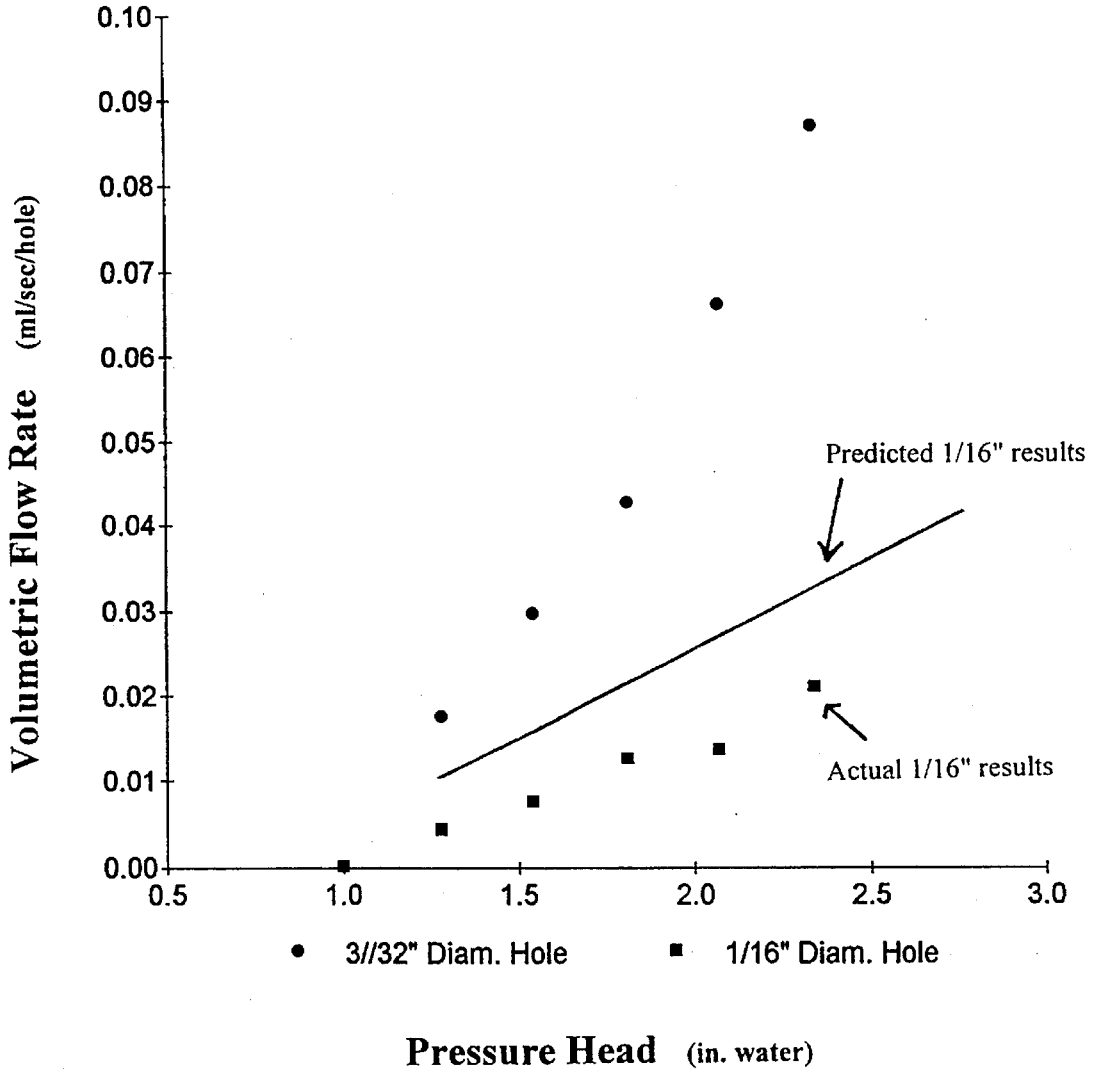
FIG. 8 is a graph showing flow rates for a high viscosity skin preparation through a canister having two apertures.

B. High Viscosity Skin Preparation FIG. 8 shows the plotted data for a lotion skin preparation product (Avon Sun Seekers Ultra Sunblock Lotion). This lotion was selected from the cream lotions as the least viscous. In fact its viscosity was about 100 times that of water. It has a specific gravity of 1.0, a density the same as water. This product behaved quite differently from the mineral oil product. Table 2 contains the volumetric flow rates for the lotion skin preparation at 72° F.

| PRESSURE | VOLUMETRIC FLOW RATES (ml/sec/hole) | |
|---|---|---|
| HEAD (in $H_2O$) | 3/32" diameter hole | 1/16" diameter hole |
| 2.34 | 0.0870 | 0.0211 |
| 2.07 | 0.0662 | 0.0138 |
| 1.81 | 0.0427 | 0.0127 |
| 1.54 | 0.0298 | 0.0076 |
| 1.28 | 0.0177 | 0.0044 |
| 1.00 | — | 0.0020 |

As in the previous experiment, flow rates were measured for a range of pressure heads and for two hole diameters. No linear relationship between flow rate and pressure head was shown for this product. An extrapolation of the data to zero flow rate yielded a non-zero pressure head. This indicated that some finite force is needed to promote flow once the level of lotion drops below some critical level in the applicator, it does not flow out due to gravity alone. The flow rate is no longer proportional to the square of the radius as shown in FIG. 8 by the poor prediction.

C. Effect of Porous Layer

Figure 9:
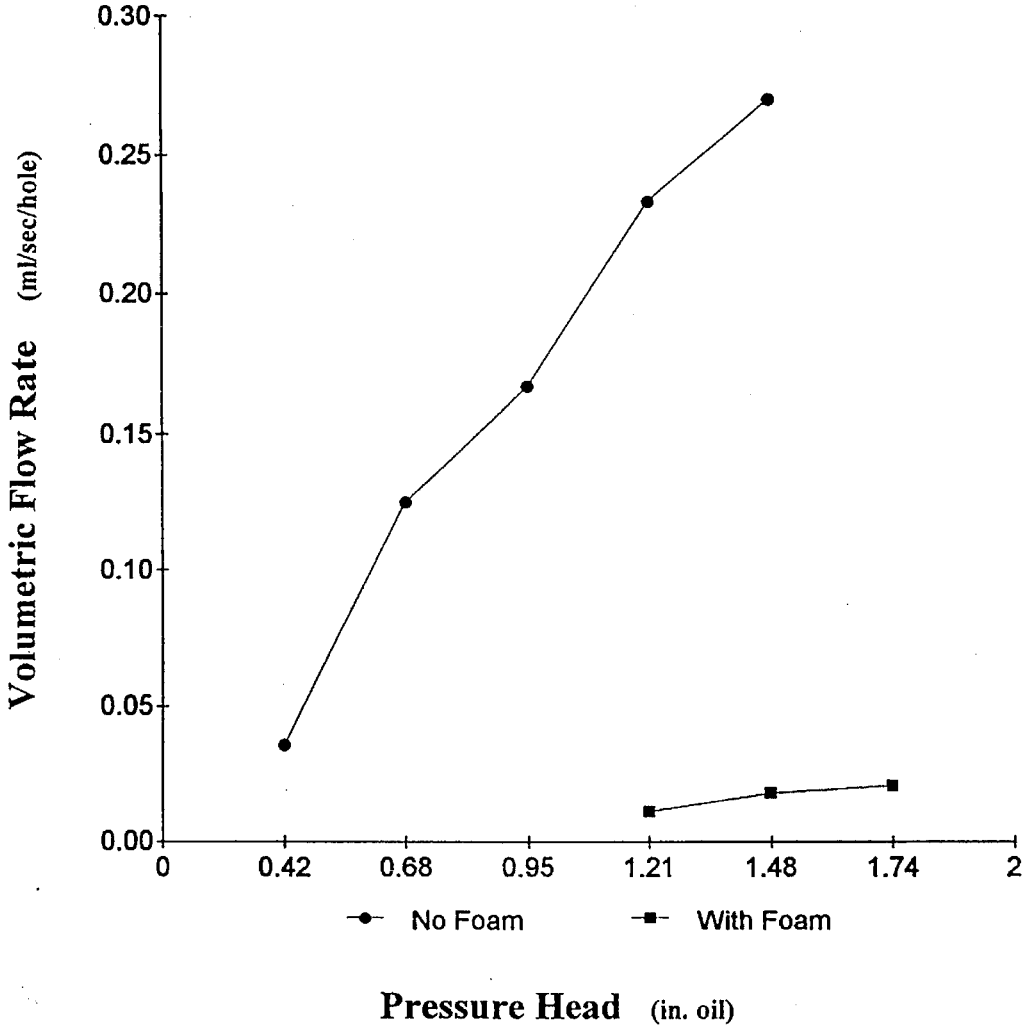
FIG. 9 is a graph which shows the effect of a porous layer on flow from the canister.

Experiments were conducted to determine the effect of an open cell foam type of porous layer having a porosity of 4.5 PCF on the flow rate of the mineral oil-based product from the applicator. The first set of measurements were obtained using two 1/16 inch (0.159 cm) diameter holes drilled in the sidewall at 0.86 inches (2.18 cm) from the bottom of the applicator. The flow rates were measured for various heights of product in the applicator both with and without the porous layer. These results are shown in FIG. 9.

The porous layer greatly restricted the flow of the lotion from the applicator. Without the porous layer, the flow rate was about 15 times the rate with the porous layer. This flow rate data is given in Table 3 for mineral oil based products at 72° F both with and without the porous layer.

| | | VOLUMETRIC FLOW RATES (ml/sec) 1/16" diameter holes | | |
|---|---|---|---|---|
| PRESSURE (in $H_2O$) | HEAD (in oil) | 2 holes without foam | 2 holes with foam | 6 holes with foam |
| 1.49 | 1.74 | — | 0.021 | 0.041 |
| 1.27 | 1.48 | 0.270 | 0.018 | 0.042 |
| 1.04 | 1.21 | 0.233 | 0.011 | 0.034 |
| 0.82 | 0.95 | 0.167 | — | 0.023 |
| 0.59 | 0.68 | 0.125 | — | 0.021 |
| 0.36 | 0.42 | 0.036 | — | 0.014 |

Eventually the oil seemed to saturate the porous layer up to a height of about 1/2 inch (1.27 cm) above the level of the holes. Because the flow rates with the porous layer and having only two holes in the applicator were so low, the test was done over using six holes in the applicator, all at the same liquid height. The canister was filled with lotion, and measurements of flow rate were taken after the level fell to a predetermined height. Measurements were continued as the level of lotion in the container continued to drop. Thus, as the level dropped, the porous layer became more saturated. It was expected that the flow rate for six holes would be three times that for just two holes, but it was about 50% less for some of the data. The porous layer tended to draw the lotion from the container initially, but was quickly saturated in the area of the holes and retarded the flow considerably.

Figure 10:
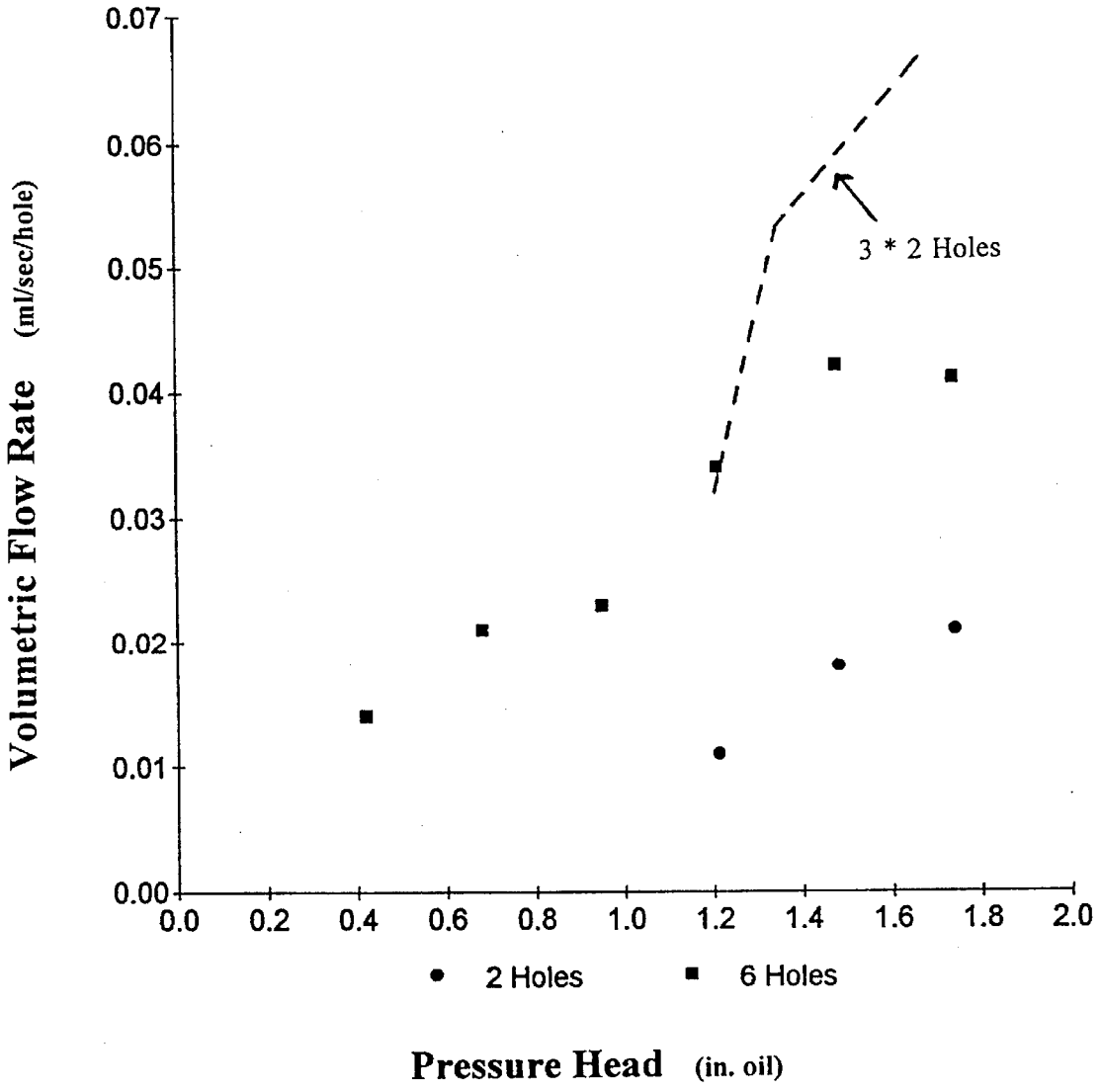
FIG. 10 shows a graph depicting the effect of a porous layer on flow through a canister having two and six apertures.

The dashed curve, as shown in FIG. 10, represents the predicted flow rate of 3 times the flow data for two holes. Initially, the porous layer in the area of the two holes was relatively free of oil. As the experiment progressed, the porous layer became saturated and the flow rate decreased. For the experience with six holes, the porous layer was quickly saturated during the filling of the canister.

D. Summary of Experiments

It was determined that three forces promote flow through the holes. Two of these, gravitational and centrifugal, can easily be computed. These driving forces are balanced by the viscous losses occurring with flow through the applicator (through both the porous layer and the holes in the canister).

Gravitational forces are the product of the skin preparation density (specific gravity) times the height of skin preparation in the applicator. For the applicator where a typical height of skin preparation might be 1 inch, the pressure due to gravitational forces will be about 0.03 psi. It is also customary to express this as a pressure head such as, the pressure is equivalent to 1.0 inches (2.54 cm) of water. Since the high viscosity skin preparation has the same specific gravity as water, one inch of water is equivalent to one inch of high viscosity skin preparation in terms of pressure head. The specific gravity of the mineral oil based product was about 0.86. Thus, the pressure head due to 0.86 inches (2.18 cm) of water is equivalent to the pressure head due to 1.0 inches (2.54 cm) of mineral oil.

The rotation of the applicator will impact a centrifugal force to the lotion. Assuming a typical speed of the applicator to be one foot per second, the equivalent pressure head due to the centrifugal force is 0.006 psi or about 0.2 inches (0.508 cm) of water. Thus the centrifugal force is only one-fifth as large as the gravitational force.

Gravity (the height of fluid in the container) was found to be the largest driving force. The centrifugal force from rolling the applicator had little effect. The porous layer had the biggest effect on the delivery of the skin preparation. It is believed that the act of using the applicator and squeezing the skin preparation from the porous layer will result in flow rates about the same as if there were no porous layer. But when the applicator is not being used, the porous layer will tend to greatly restrict the flow of skin preparation from the canister.

While a particular embodiment of the present invention has been illustrated and described, it would be obvious to those skilled in the art that various other changes and modifications can be made without departing from the spirit and scope of the invention. It is, therefore, intended to cover in the appended claims all such changes and modifications that are within the scope of this invention.

What is claimed is:

1. A roller applicator for applying a fluid to human skin, comprising:

a sealed canister for containing said fluid having a first end, a second end, an exterior surface, and a longitudinal axis that runs between said first and second ends;

said canister further comprising a receptacle at said first end and a plurality of apertures open to said exterior surface;

a handle having a neck portion for inserting into said receptacle, and a grip portion;

said neck portion being essentially parallel to said longitudinal axis of said canister;

said grip portion and said neck portion being substantially non-parallel to one another;

said canister being free to rotate about said neck portion;

there being a means for locking said canister such that said canister is restricted from rotating about said neck portion; and said fluid comprising an, oil, lotion, cream or other skin care product.

2. The applicator of claim 1 further comprising a porous layer positioned axially around said exterior surface of said canister.

3. The applicator of claim 2 wherein said porous layer has a thickness ranging from about 0.015 inch (0.0381 cm) to about 0.125 inch (0.318 cm).

4. The applicator of claim 1 wherein said means for locking said canister is a pin located on said handle engageable with an opening located on said first end of said canister.

5. The applicator of claim 1 wherein said canister further comprises a concave bottom at said second end for urging said fluid against said apertures.

6. The applicator of claim 1 wherein said apertures are arranged such that said canister has a greater quantity of apertures located near said first end than near said second end.

7. The applicator of claim 1 wherein said apertures have a diameter ranging from about 0.015 inch (0.0381 cm) to about 0.125 inch (0.318 cm).

8. The applicator of claim 1 further comprising a container for enclosing said canister when said canister is not in use said container is sized such that said porous layer is compressed for maintaining said fluid within said canister.

9. The applicator of claim 1 wherein said handle further comprises a means for extending said grip portion.

10. A roller applicator for applying a fluid to human skin, comprising:

a sealed canister for containing said fluid having a first end, a second end, an exterior surface, and a longitudinal axis that runs between said first and second ends;

said canister further comprising a receptacle at said first end and a plurality of apertures open to said exterior surface;

a handle having a neck portion for inserting into said receptacle, and a grip portion;

said neck portion being essentially parallel to said longitudinal axis of said canister;

said grip portion and said neck portion being substantially non-parallel to one another;

said canister being free to rotate about said neck portion;

there being a means for locking said canister such that said canister is restricted from rotating about said neck portion;

said fluid comprising an, oil, lotion, cream or other skin care product; a porous layer positioned axially around said exterior surface of said canister; and a means for extending said grip portion.

11. The applicator of claim 10 wherein said canister further comprises a concave bottom at said second end for urging said fluid against said apertures.

12. The applicator of claim 10 wherein said apertures are arranged such that said canister has a greater quantity of apertures located near said first end that near said second end of said canister.

13. The applicator of claim 10 further comprising a container for enclosing said canister when said canister is not in use, said container is sized such that said porous layer is compressed for maintaining said fluid within said canister.

* * * * *